United States Patent [19]

Hayashi et al.

[11] Patent Number: 4,610,531

[45] Date of Patent: Sep. 9, 1986

[54] DEVELOPING METHOD AND APPARATUS

[75] Inventors: Nobuhiro Hayashi, Yokohama; Kimio Nakahata, Kawasaki; Hatsuo Tajima, Matsudo; Shunji Nakamura, Kawasaki, all of Japan

[73] Assignee: Canon Kabushiki Kaisha, Tokyo, Japan

[21] Appl. No.: 644,560

[22] Filed: Aug. 27, 1984

[30] Foreign Application Priority Data

| | | | |
|---|---|---|---|
| Sep. 5, 1983 | [JP] | Japan | 58-162803 |
| Sep. 5, 1983 | [JP] | Japan | 58-162804 |
| Dec. 22, 1983 | [JP] | Japan | 58-243446 |

[51] Int. Cl.[4] ..... G03G 15/08

[52] U.S. Cl. ..... 355/14 D; 355/3 DD; 118/657; 430/35; 430/122

[58] Field of Search ..... 355/3 DD, 14 D, 3 R, 355/14 R; 430/35, 120, 122; 118/653, 657

[56] References Cited

U.S. PATENT DOCUMENTS

| | | | |
|---|---|---|---|
| 4,383,497 | 5/1983 | Tajima | 355/3 DD X |
| 4,478,505 | 10/1984 | Tashiro | 355/14 D X |
| 4,482,243 | 11/1984 | Suzuki et al. | 355/3 DD X |
| 4,496,644 | 1/1985 | Ateya et al. | 355/3 DD X |
| 4,511,240 | 4/1985 | Suzuki et al. | 355/14 E X |

*Primary Examiner*—A. C. Prescott

*Attorney, Agent, or Firm*—Fitzpatrick, Cella, Harper & Scinto

[57] ABSTRACT

A method of development including the steps of forming a thin layer of developer on a surface of a developer carrying member; opposing the surface of the developer carrying member to a latent image bearing member bearing a latent image to be developed with a clearance therebetween which is larger than the thickness of the thin developer layer at a developing position; and intermittently forming an alternating electric field, as a developing bias, across the clearance.

18 Claims, 15 Drawing Figures

DEVELOPING METHOD AND APPARATUS

BACKGROUND OF THE INVENTION

The present invention relates to a developing method and apparatus, more particularly, to such a method and apparatus wherein a developer is carried on a developer carrying member and opposed to a latent image bearing member with a clearance or gap therebetween at a developing station, where the developer is transferred from the developer carrying member to the latent image bearing member to visualize the image on the latent image bearing member.

It is known, for example, from U.S. Pat. Nos. 3,232,190, 3,866,574, 3,890,929 and 3,893,418, that the developer carrying member carrying a thin layer of a dry developer is opposed to the latent image bearing member at the developing station with a clearance therebetween which is larger than the thickness of the thin developer layer, and the developer is transferred through the clearance to the latent image bearing member, thus developing the latent image. Furthermore, it is also known from U.S. Pat. No. 4,395,476, that an alternating electric field is continuously formed in the clearance to cause repeated reciprocations, that is, transfer and back-transfer, of the developer particles in the clearance between the surface of the developer carrying member and the surface of the latent image bearing member. This will be called a "jumping development". This development is advantageous in that no foggy background is produced, that the tone reproducibility is good and that thin lines are acceptably reproduced.

SUMMARY OF THE INVENTION

Although this development system is advantageous, the present inventors have found a problem.

The relation between the image density D after development and the surface potential V (latent image potential) on the latent image bearing member in this development system is generally represented as a curve (a) shown in FIG. 1.

However, it has been found that, if a nonmagnetic, rather than a magnetic, developer is applied on the developer carrying member as the thin layer of the developer and is opposed to a latent image bearing member at the developing station with the clearance in which an alternating electric field is continuously applied, the V-D curve is as shown by (b) of FIG. 1. This is very different from the ordinary V-D curve as shown by reference (a), in that the development is excessively promoted in an intermediate potential region B so that the inclination of the image density with respect to the latent image potential is steep, and that the image density D is low in the high potential region A. This property will hereinafter be called "negative property". This is a problem because the image density at a solid black area is lower than that at a half-toner area, which is not practical.

Accordingly, it is a principal object of the present invention to provide a developing method and apparatus which is substantially free from the above drawbacks of the prior art system, that is, wherein the above-described negative property in the developing process is effectively prevented.

It is another object of the present invention to provide a method and apparatus which reproduces faithfully an original without foggy background.

It is a further object of the present invention to provide a developing method and apparatus using a developing magnetic pole, wherein an occurrence of stripes due to a non-uniform magnetic flux density distribution in the longitudinal direction of the developing magnetic pole is effectively prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Before describing in detail the preferred embodiments of the present invention, the negative property of development will further be discussed.

It is thought that the negative property arises as a peculiar phenomenon caused by the developer particles which have become a powder cloud by the reciprocal movement of the non-magnetic developer particles in the clearance in which the alternating field exists. More particularly, it is thought that the developer particles repeat the reciprocal movement in response to the frequency of the developing bias, but when the frequency of the bias is high, the developer particles can not follow the alternation of the bias at such a high frequency, so that the particles form the powder cloud.

Figure 1:
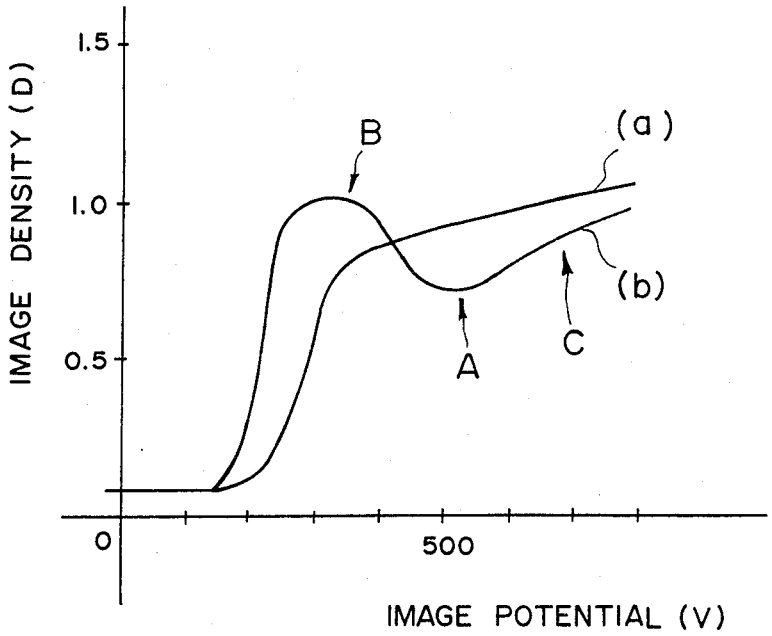
FIG. 1 is a graph showing an ordinary V-D curve (the relation between the developed image density and the latent image density) and a V-D curve having the negative property.

In the high potential region A of FIG. 1, it is thought that the electric field between the latent image bearing member and the developer carrying member is so high that the reciprocal movement of the developer particles results in the formation of something like a curtain by the developer particles chained in the clearance between the latent image bearing member and the developer carrying member, and that the developer particles are confined in this curtain so as not to go out of the curtain in the direction of the thickness of the curtain, with the result that the formed cloud is smaller. However, it is considered that, in the low potential region B, the electric field in the clearance between the latent image bearing member and the developer carrying member is weaker than in the high potential region A so that the curtain is formed only in the region where the clearance is very small, and therefore, the thickness of the curtain is so small that the developer particles are relatively easily released, with the result of a wider cloud, that is, a wider development zone. Actually, it is observed that the developing zone width while the alternating electric field is being applied, is larger in the low potential region B than in the high potential region A. It is thought that this is because the developing width is enlarged by the formation of the powder cloud. Also, this is supported by the fact that an edge effect is confirmed in the low potential region B, which effect is peculiar to the powder cloud development.

In a conventional developing system wherein a magnetic developer (magnetic toner) is used and a developing magnetic pole is provided at the developing position, the powder cloud is not easily produced because the magnetic force of the developing pole is applied to the magnetic toner particles toward the developer carrying member. Furthermore, the developing magnetic pole creates chains of toner particles which chains are erected so that the gap between the ends of the chains and the latent image bearing member is reduced at the developing zone, with the result that the image density in the high potential region A is sufficient as shown by the V-D curve (a) in FIG. 1. On the contrary, in the case where the magnetic toner is used without the use of the developing magnetic pole, or where non-magnetic toner is used, the toner particles are applied on the surface of the developer carrying member at a higher density, so that the toner particles are not easily transferred to the latent image bearing member. Also, there is no such a force as would tend to move the toner particles back to the developer carrying member. For those reasons, the toner particles having a high charge density are floating or suspended inside the curtain, and therefore, a sufficient electric field is not applied to transfer the toner particles from the developer carrying member to the latent image bearing member. It is considered that this is the reason why the image density is decreased in the region A as shown by the V-D curve (b) of FIG. 1. Furthermore, it is considered that, in the higher potential region C wherein the potential is higher than in the region A, the electric field is stronger than in the region A so that the image density increases with the latent image potential. As a result, in the intermediate potential region B of FIG. 1, it is thought that the width of the developing zone is increased to provide a high density developed image, whereas, in the high potential region A, the image density is decreased.

The inventors' experiments showed that the negative property did not take place when a DC was used as the developing bias, or when an AC was used which had such a low frequency that the developer particles could follow the frequency to repeat the sufficient reciprocation of the developer particles. It follows that, in order to avoid the occurrence of the negative property, it might be considered that a low frequency bias should be used so as to reduce the number of reciprocal movements. However, it has been confirmed that, if the frequency of the developing bias is simply reduced, the image density is decreased, and the background fog is increased, in other words, the quality of the image is degraded.

According to the present invention, the frequency of the developing bias to be applied is maintained. Instead, the timing of the developing bias application is controlled so that the developing bias is applied intermittently. It has been confirmed that the negative property has been extinguished or remarkably reduced.

Figure 2:
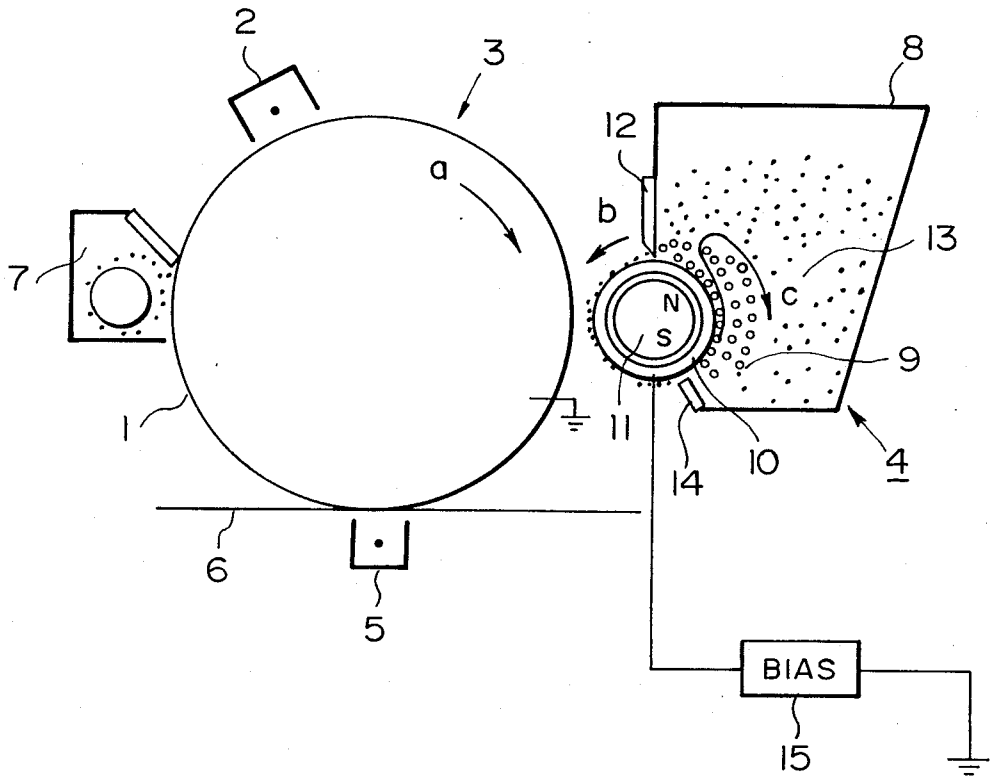
FIG. 2 is a schematic cross-section of a copying apparatus according to an embodiment of the present invention.

Now, an embodiment of the present invention will be described. Referring to FIG. 2, there is shown a copying apparatus according to an embodiment of the present invention, wherein a latent image bearing member 1 having a photoconductive layer is rotatable in the direction shown by an arrow a. The latent image bearing member 1 is uniformly charged by a corona discharger 2 and is subjected to an image exposure 3 in accordance with an original to be copied so that a latent image is formed on the latent image bearing member 1. Then, the latent image thus formed is developed or visualized by the developing device 4. The visualized image is then transferred from the latent image bearing member 1 to a transfer material 6, such as paper, by the transfer discharger 5. The image on the transfer material 6 is fixed by an image fixing device (not shown). The surface of the latent image bearing member 1 after the image has been transferred therefrom, is cleaned by a cleaning device 7. The developing device 4, which is the major part of the present invention, will be described in further detail. The developing device 4 comprises a developer container 8 which contains magnetic particles 9. The magnetic particles 9 are attracted onto a surface of a sleeve 10 by the magnetic force provided by the magnet roller 11 contained in the sleeve 10. The sleeve 10 functions as the developer carrying member and is rotatable in the direction of arrow b. The magnetic particles 9 are conveyed on the sleeve 10, while it is being rotated. However, the magnetic particles 9 are prevented from going out of the developer container 8 by the cooperation of the confining blade 12 of a magnetic material and the magnetic pole N of the magnet roller 11 so that they turn by the gravity as shown by an arrow C. As a result, a thin layer of the non-magnetic toner particles 13 is formed uniformly on the sleeve 10. The non-magnetic toner particles 13 as a thin layer are conveyed on the sleeve 10 in the direction of the arrow b to the developing position, where the sleeve 10 is opposed to the latent image bearing member 1. At the developing position, the sleeve 10 is opposed to the latent image bearing member 1 with a clearance which is larger than the thickness of the thin toner layer. The clearance is formed by spacer means, for example, rolls provided at the opposite longitudinal ends of the sleeve 10. On the other hand, the magnetic particles 9 which circulate in the direction of the arrow C take in among themselves the non-magnetic toner particles 13 during the circulation. This circultaion is repeated. The method of the thin layer formation of the nonmagnetic toner particles is explained in detail in U.S. Ser. No. 601,715 which has been assigned to the assignee of the present application.

The developing device 4 further includes a sealing member 14 of a magnetic material which serves to prevent the leakage of the magnetic particles out of the developer container 8 by the cooperation with the magnetic pole S of the magnet roller 11. To the sleeve 10, a developing bias voltage is applied by the bias source 15.

Figure 3:
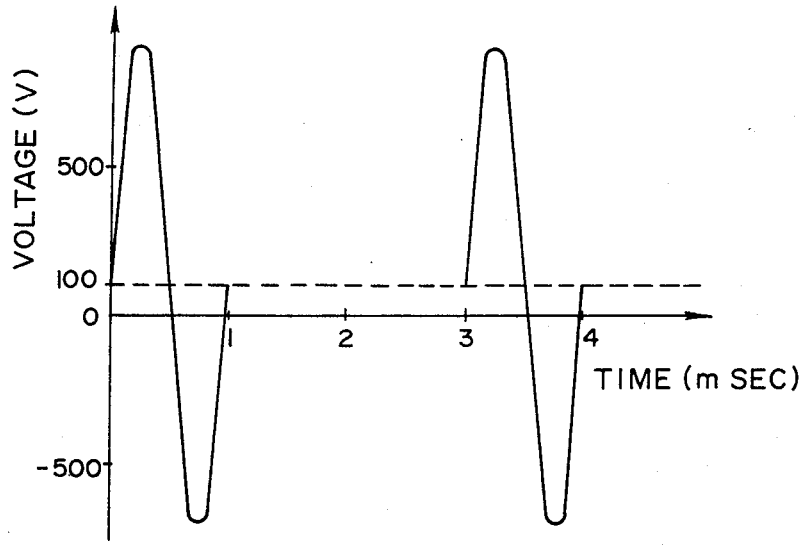
FIGS. 3–6 show waveforms of the developing bias voltage according to the present invention.

To the sleeve 10 of the developing device 4, a developing bias voltage as shown in FIG. 3 is applied by the bias voltage source 15. The bias voltage source 15 comprises an oscillator for generating a sine wave alternating current, a modulator for intermittently generating pulses as shown in FIG. 3, an amplifier for amplifying the amplitude and means for superposing a DC current. The output voltage has the frequency of 1 KHz, the peak-to-peak voltage of 1.6 KVp-p, and is superposed with a DC of +100 V. And, one full cycle of this voltage is repeatedly applied to the sleeve 10 with the rest period of 2 msec., as shown in FIG. 3. The latent image on the latent image bearing member 1 used was such that the dark area potential Vd was +550 V, and that the light area potential V1 was 0 V. The toner particles used were insulating non-magnetic toner particles which were negatively chargeable by the friction with the sleeve 10 or with the magnetic particles 9.

When the developing operation was actually performed under the above described conditions, it was confirmed that the negative property shown by curve (b) in FIG. 1 was extinguished, and that the V-D curve which was close to the curve (a) of FIG. 1 was obtained.

Figure 5:
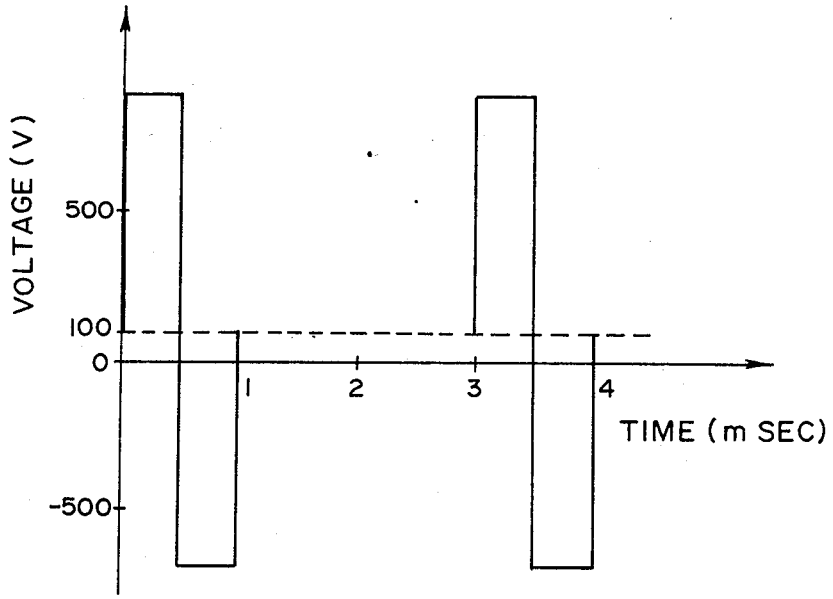

As an alternative, two full cycles of the voltage may be applied with the rest period corresponding to one full cycle. Also, a rectangular waveform as shown in FIG. 5 or a triangular waveform may be used. The most suitable form of voltage application can be selected in accordance with the desired speed of copy or developing conditions. The preferable results were confirmed when the ratio of the bias applying period and the resting period is $1:\frac{1}{2}$–1:10.

According to this embodiment of the present invention, the alternating electric field is intermittently formed between the latent image bearing member and the developer carrying member at the developing position where they are opposed, so that the occurrence of the negative property is eliminated or reduced. In addition, reduction in the image density and the occurrence of the background fog are prevented, which are possible when the frequency is simply decreased.

It has been found that the degree of the improvement in the negative property reduction, is more or less different depending on the manner of the intermittent bias voltage application.

Figure 4:
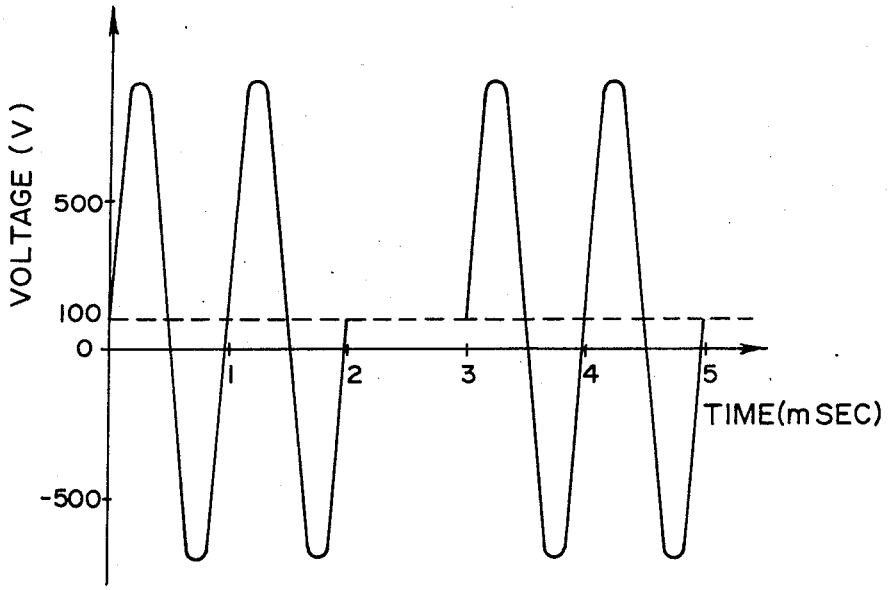
Figure 6:
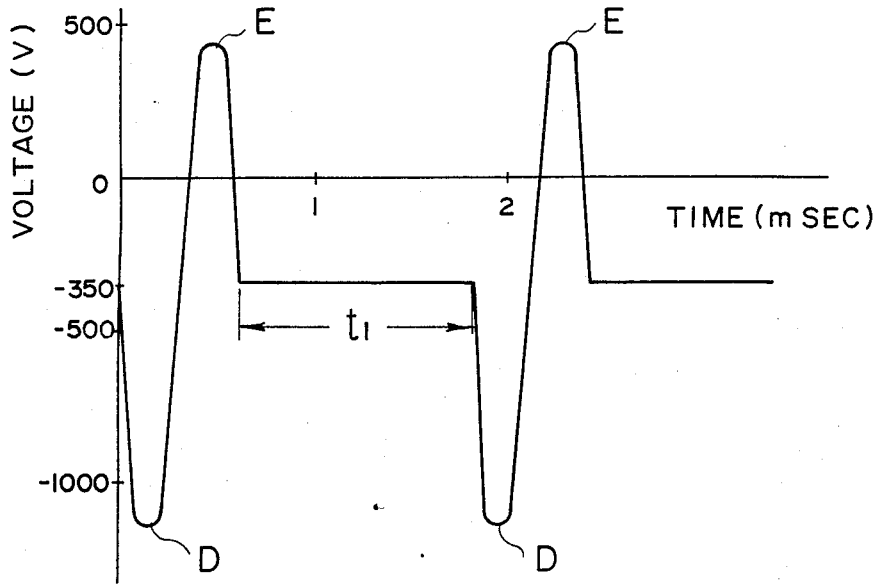

Another embodiment of the present invention on the basis of this finding will be described. Experiments were carried out under the following conditions. An electrostatic latent image was formed on the latent image bearing member 1 having a organic photosensitive member. The latent image had −650 V at the dark area and −150 V at the light area. Positively charged toner particles 13 were used to develop the latent image. The developer carrying member 10 was opposed to the latent image bearing member 1 at the developing station, and an intermittent alternating field as shown in FIG. 6 was applied therebetween. Since the developer particles are positively charged, while the polarity of the latent image is negative, the alternating electric field starts with a step or phase D (back transition step), in which the developer particles are transferred or transited back to the developer carrying member 10 from the latent image bearing member 1. The alternating field ends with a step or phase E (transition step), in which the developer particles are transferred or transited from the developer carrying member 10 to the latent image bearing member 1. This pattern of the voltage application is the same as with FIGS. 3–5, since the latent image is of positive polarity, and the developer is of negative polarity in FIG. 2.

When this pattern of voltage is applied, the effects of the negative property reduction and the fog prevention are not very remarkable. The reasons for this are thought to be as follows. Since the intermittent alternating field ends with the step in which the developer particles are transferred from the developer carrying member 10 to the latent image bearing member 1, the powder cloud developer particles existing between the latent image bearing member 1 and the developer carrying member 10 are easily kept in the floating state during the resting period t1. Therefore, the background fog is easily produced, and the floating developer particles obstruct the transition or transferring movement of the developer particles in the next transition step.

Figure 7:
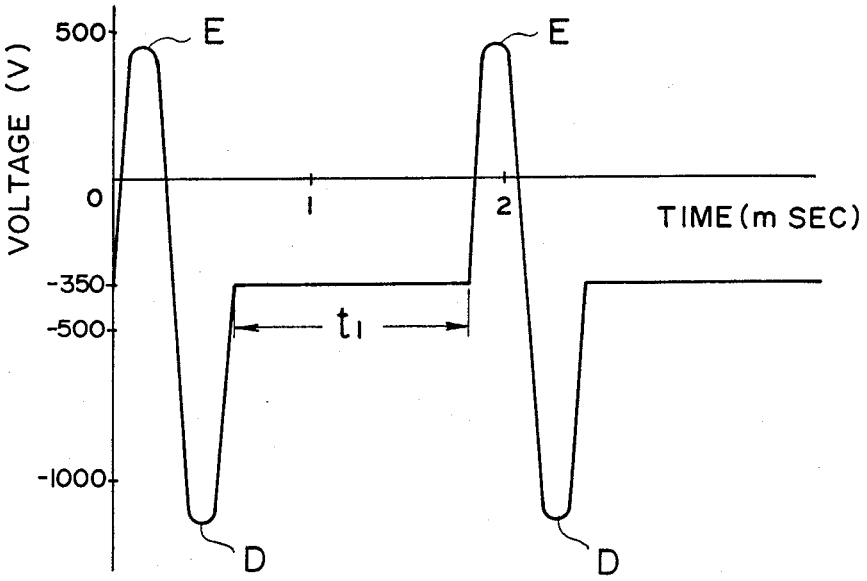
FIGS. 7–9 show the waveforms of the developing bias voltage according to another embodiment of the present invention.

In said other embodiment of the present invention, the pattern of the bias voltage application is reversed so that the movement of the developer particles caused by the intermittent alternating field is reversed. More particularly, the intermittent alternating field applied is as shown in FIG. 7, wherein the intermittent alternating electric field ends with the back transition step in which the developer particles are transferred back from the latent image bearing member 1 to the developer carrying member 10. With this pattern of the intermittent alternating electric field, the negative property of development is remarkably reduced, and faithful reproduction of the tone is obtained without the foggy background. In this alternating field, during the voltage being positive, the developer is released from the developer carrying member 10 and transferred to the latent image bearing member 1 to develop the latent image thereon. Among the developer particles being transferred, there are some particles which do not reach the surface of the latent image bearing member 1 due to the amount of charge thereof and the developing time period (the time period during which the bias voltage is applied). Such particles thus begin floating, and then in the next step (back transition step), the floating developing particles are transferred back to the developer carrying member 11. Therefore, during the resting time t1 between the adjacent intermittent alternating voltage applications, there is a state wherein the clearance is free from the floating toner particles. Accordingly, the developer particles are easily transferred in the next developing step.

The negative property in the development is reduced by simply reducing the frequency of the developing bias voltage, but this results in the lower image density and the production of the background fog, as explained hereinbefore. According to this embodiment of the present invention, however, the high frequency developing bias voltage is used so that the advantages thereof of the fog prevention and high image density, are maintained, and the negative property is still reduced. This is accomplished by the intermittent alternating field ending with the back transition step or phase wherein the developer particles are transferred back from the latent image bearing member 1 to the developer carrying member 10, so that the amount of the floating toner particles is reduced and that the number of reciprocation of the developer particles is also reduced. Further, since the alternating electric field is such that the resting period starts immediately after the back transition step wherein the developer particles are transferred back to the developer carrying member 10, it is difficult for the floating developer particles to be produced in the clearance between the latent image bearing member 1 and the developer carrying member 10. This is advantageous since the possible scattering of the developer particles can be reduced, which may otherwise be caused by the rotation of the latent image bearing member.

This embodiment of the present invention was actually operated with a developing device having the structures shown in FIG. 2. The developing bias voltage as shown in FIG. 7 was applied to the developing sleeve 10 from the bias voltage source 15. The bias voltage had the frequency of 1.5 KHz, and the peak-to-peak voltage of 1.6 KVp-p, superposed with a DC component of −350 V. One full cycle of the voltage was applied with the resting period t1 of 1.3 msec. to the sleeve 10, as shown in FIG. 7. The latent image developed was such that the dark area surface potential Vd was −650 V, and the light area surface potential Vl was −150 V. The developer particles used were insulating non-magnetic toner particles which were positively chargeable by the friction with the sleeve 10 or the magnetic particles.

When it was operated, the negative property shown by curve (b) of FIG. 1 was extinguished, and the V-D which was close to the curve (a) of FIG. 1 was obtained.

In this embodiment, the positively charged toner particles are used for the negative latent image so that the alternating field ends with the negative polarity before the resting period. When, however, a positive latent image is developed with a negatively charged developer (FIGS. 2–5), the ending polarity is reversed, that is, to be positive so that the negative property is also remarkably removed.

Figure 8:
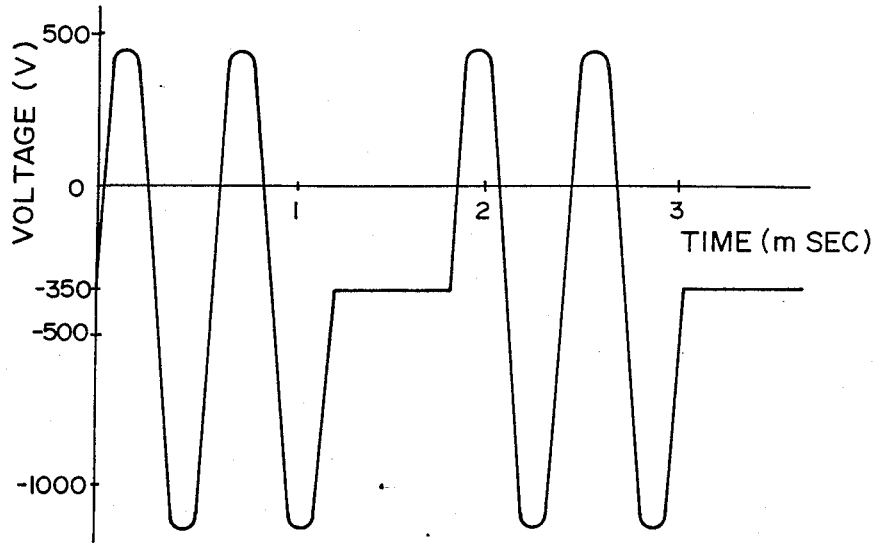
Figure 9:
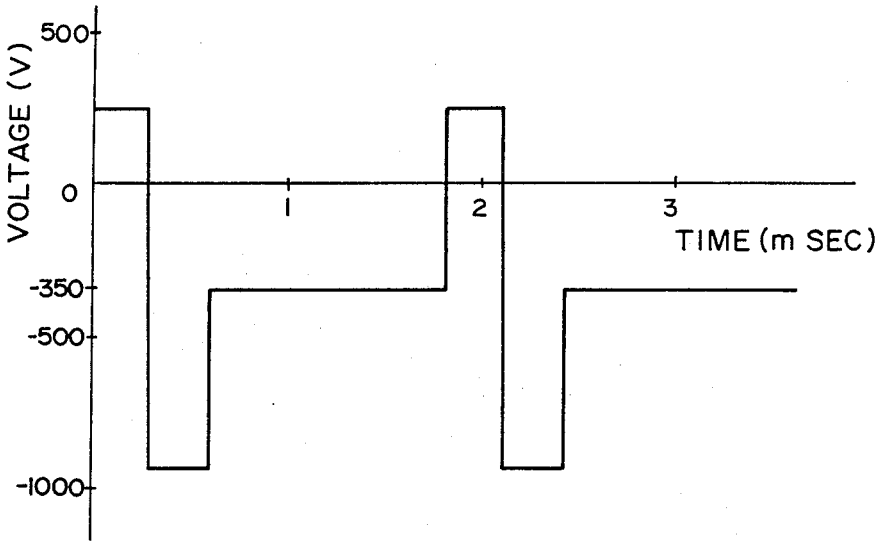

As an alternative of the present invention, two cycles of the voltage may be applied with the resting period of one cycle of the wave, as shown in FIG. 8. Also, the rectangular waveform as shown in FIG. 9 or a triangular waveform may be used. The most suitable pattern of the application of the voltage can be selected in accordance with the desired copying speed and the developing conditions. The waveform of the bias voltage suffices if it includes one cycle of the waveform containing the transition component and the back transition component. The waveform may start with the back transition component and also end with the back transition component. The preferable results were obtained when the ratio of the bias voltage application period and the resting period is 1:½–1:10.

The present invention is not limited to the developing device shown in FIG. 2, but it is applicable to another type of developing device which can produce the negative property when a continuous alternating electric field is applied. Although the foregoing embodiments have been described with the non-magnetic toner, the present invention is applicable to a developing device using magnetic toner particles, if the negative property is created. Also, the present invention is effectively used with a so called two-component developer system wherein magnetic carrier particles and toner particles are used.

According to this embodiment of the present invention, an intermittent alternating electric field is applied across the clearance formed between the latent image bearing member and the developer carrying member, wherein the ending component of the intermittent alternating field is such that it transfers the developer particles from the latent image bearing member to the developer carrying member. This is effective to prevent the occurrence of the negative property without lowering the quality of the image, such as the lower density or a foggy image, which may be produced when the frequency of the bias voltage is simply decreased.

In the foregoing embodiments, the intermittent bias voltage has been used to prevent the negative property shown in developing operations. The present invention is also effective in method and apparatus wherein the developing operation is effected with the use of the magnetic toner particles and the developing magnetic pole. An embodiment of this type will be described.

It is known, for example, from U.S. Pat. No. 4,292,387, that a developer carrying member having thereon a thin layer of magnetic toner particles is opposed at a developing station to a latent image bearing member with a gap between the developer carrying member and the latent image bearing member which is larger than the thickness of the thin magnetic toner layer, and that a developing magnetic field is created across the gap by a developing magnetic pole, wherein an alternating electric field is continuously formed across the gap, so that the magnetic toner particles are repeatedly reciprocated across the gap, thus developing the latent image on the latent image bearing member with the magnetic developer particles. This is a so-called jumping development system. In this system, if the magnetic flux density is not uniform in the longitudinal direction (a direction perpendicular to the movement of the latent image bearing member), the developed image involves the corresponding non-uniformness, more particularly, the developed image has white or black lines.

Figure 10:
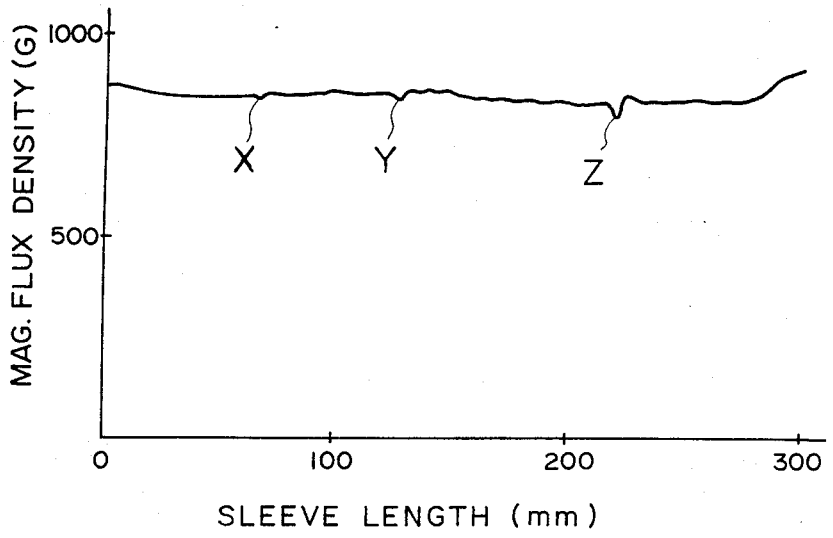
FIG. 10 is a graph showing a magnetic flux density distribution of the developing magnetic pole.

FIG. 10 shows a magnetic flux density distribution of a developing magnetic pole which produces such lines or stripes. The magnetic flux density is measured along the surface of the sleeve in the longitudinal direction, the sleeve being of non-magnetic material and functioning as the developer carrying member, which contains therein a magnet roller having the developing magnetic pole. As shown in this Figure, the magnetic flux density distribution is not uniform and includes local low flux density portions X, Y and Z. A developing operation was carried out with the sleeve and the developing magnetic pole under the conditions that the bias votlage had the frequency of 1000 Hz, peak-to-peak voltage of 1000 Vp-p, superposed with a DC of +100 V and was applied to the sleeve, in accordance with the above described jumping development system. Then, white stripes were observed on the developed image at the positions corresponding to the local spots X, Y and Z. The white lines were worse in the order of X, Y and Z. It has been confirmed that the white line is produced if there is a local decrease of not less than about 10 Gauss of the magnetic flux density within the width of 7 mm in the longitudinal direction of the sleeve, when the developing magnetic pole is of approx. 850 Gauss.

The reasons for the production of those stripes are thought to be as follows. In the jumping development system, the magnetic toner particles are transferred from the sleeve to the latent image bearing member by one of the directions of the alternating electric field, while the magnetic toner particles are transferred back from the latent image bearing member to the sleeve by the electric field in the reverse direction, so that the magnetic toner particles are reciprocated between the latent image bearing member and the sleeve. During this back transition, the magnetic force by the developing magnetic pole, in addition to the force by the electric field acts on the magnetic toner particles. If there are localized low magnetic force portions X, Y and Z as shown in FIG. 10, the magnetic force is smaller at those portions than the adjacent portions, with the result that the magnetic toner particles are attracted more to the adjacent areas during the repeated reciprocations thereof. Thus, the density of the magnetic toner particles at those portions becomes decreased. This results in the production of the white stripes. On the contrary, if there are local spots where the magnetic flux density is high, the magnetic toner particles are concentrated to such spots, since the magnetic force is strong there. This results in black stripes on the developed image.

From the foregoing analysis, it follows that the production of the stripes may be avoided by decreasing the frequency of the developing bias to reduce the number of reciprocal movements of the magnetic toner particles, since then the magnetic toner particles are prevented from concentrating to the portions which have a strong magnetic field. Actually, however, it has been confirmed that the image density is lowered, while the background fog is increased, if the frequency of the developing bias is simply decreased.

Accordingly, a further embodiment of the present invention relates to a developing system wherein magnetic developer particles are carried on the surface of the developer carrying member which contains the developing magnetic pole and opposed to the latent image bearing member. And, in this embodiment of the present invention, an intermittent alternating electric field is applied across the clearance between the developer carrying member and the latent image bearing member to reduce the number of reciprocal movements of the non-magnetic developer particles. By doing so, the production of the stripes is prevented, with a high density of the image and without the foggy background, and also, a faithful reproduction of image is obtained.

This embodiment will be described in detail in conjunction with the accompanying drawings.

Figure 11:
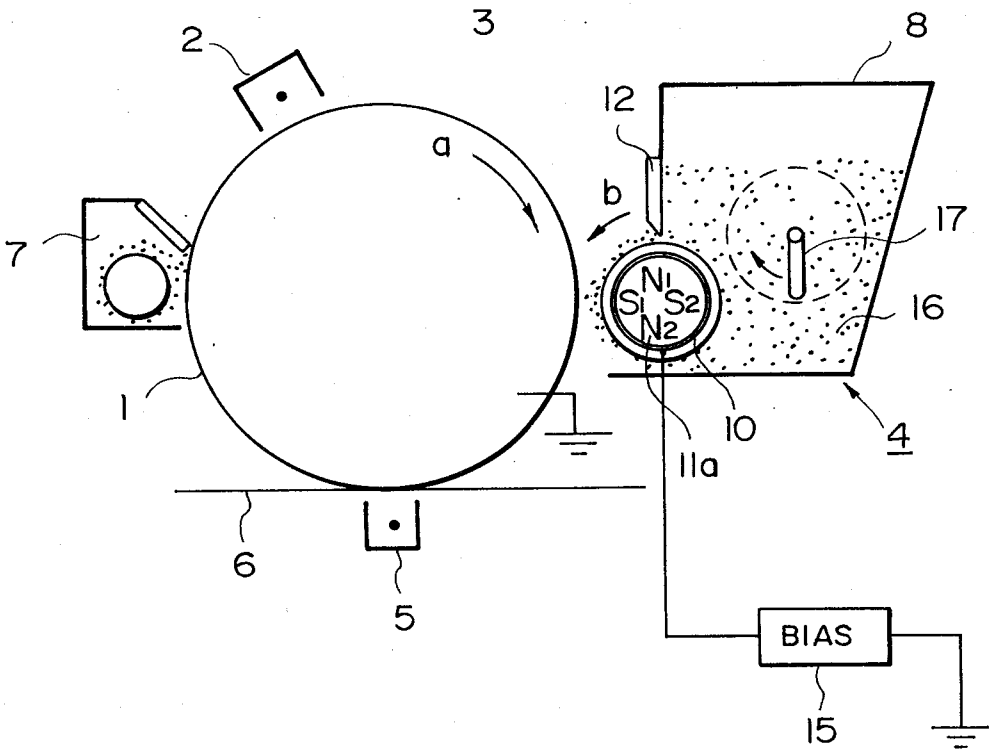
FIG. 11 is a schematic cross-section of a copying apparatus according to another embodiment of the present invention.

Referring to FIG. 11, there is shown a coying apparatus having a developing device according to this embodiment of the present invention. Since this embodiment is similar in some aspects to the embodiment described with FIG. 2, except for the portions which will be described, the detailed description of the similar parts is omitted for the sake of simplicity by assigning the same reference numerals to the elements having the corresponding functions. The developing device 4 includes the developer container 8 which contains magnetic developer particles 16. The magnetic developer particles are attracted onto a surface of the sleeve 10 which is a developer carrying member, by conveying magnetic poles N2 and S2 of the fixed magnet roller 11*a* which is contained in the sleeve 10. The magnetic developer particles 16 are conveyed on the sleeve 10 by the rotation thereof in the direction of an arrow b. The magnetic developer particles conveyed by the sleeve 10 are applied on the surface of the sleeve 10 as a uniformly thin layer of the developer by the cooperation of the magnetic pole N1 of the magnet roller 11*a* and the magnetic blade which is a developer layer thickness regulating member. The magnetic developer particles are conveyed as a thin layer to the developing position where they are opposed to the latent image bearing member 1. The magnet roller 11*a* has a developing magnetic pole S1 at the developing station. Between the latent image bearing member 1 and the sleeve 10, an alternating voltage is applied by a developing bias source 15 to create an alternating electric field across the developing clearance therebetween. The developing device 4 further includes a stirring member 17 for preventing the bridging of the magnetic developer particles.

Figure 12:
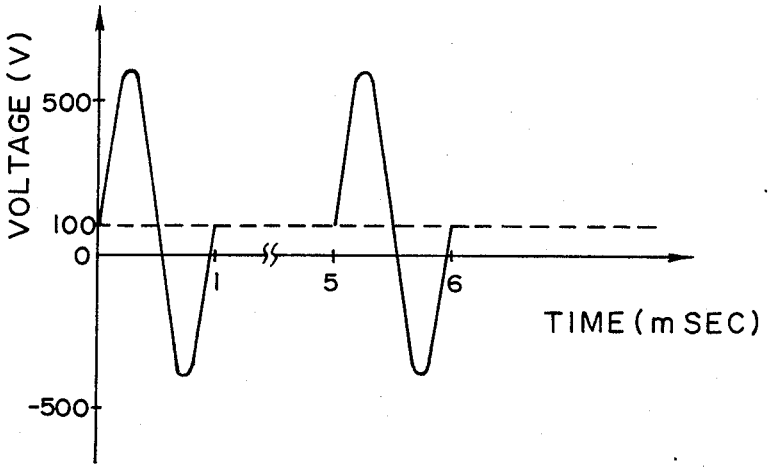
FIGS. 12–15 show the waveforms of the developing bias voltage used with the further embodiment of the present invention.

The developing device 4 according to this embodiment of the present invention was actually operated under the following conditions. The developing magnetic pole S1 of the magnet roller 11*a* was such as shown in FIG. 10. To the sleeve 10, a bias voltage having the waveform shown in FIG. 12 was applied by the developing bias source 15. The developing bias had the frequency of 1000 Hz, peak-to-peak voltage of 1000 Vp-p, superposed with a DC of +100 V. One full cycle of the voltage was applied every 5 cycles of the voltage. The developing bias of such characteristics may be provided by an oscillator for producing a sine wave alternating current, a modulator for producing intermittent pulses as shown in FIG. 12, an amplifier for amplifying the amplitude and a circuit for superposing the DC voltage thereto. Those means are contained in the bias voltage source 15. The developer particles used were one-component magnetic and insulating toner particles having 30 wt. % of magnetite, which toner particles were negatively chargeable by triboelectricity. On the sleeve 10, a thin layer of magnetic toner particles having 80 microns thickness is formed by the magnetic blade 12, and the clearance between the sleeve 10 and the latent image bearing member 1 is maintained 250 microns. The latent image developed on the latent image bearing member 1 was such that the dark area surface potential Vd was +500 V and the light area surface potential Vl was 0 V. The peripheral speed of the latent image bearing member 1 was 100 mm/sec., and the peripheral speed of the sleeve 10 was set to be a little lower than that.

Figure 13:
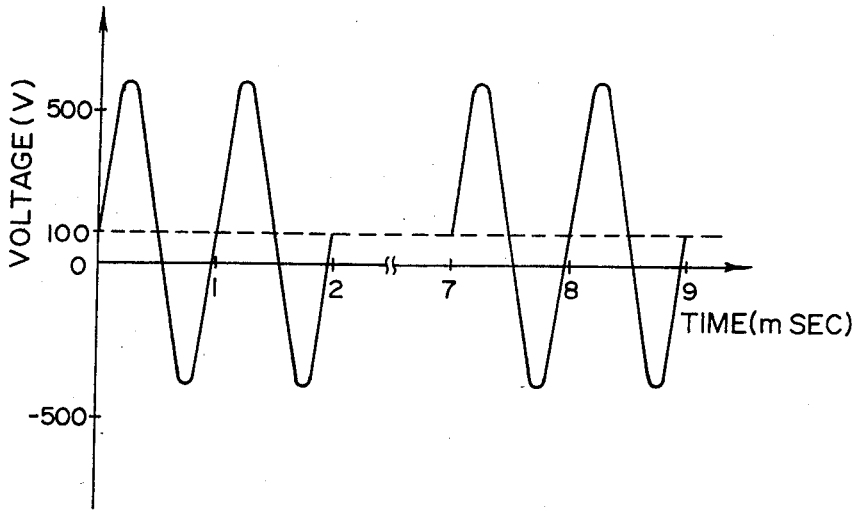
Figure 14:
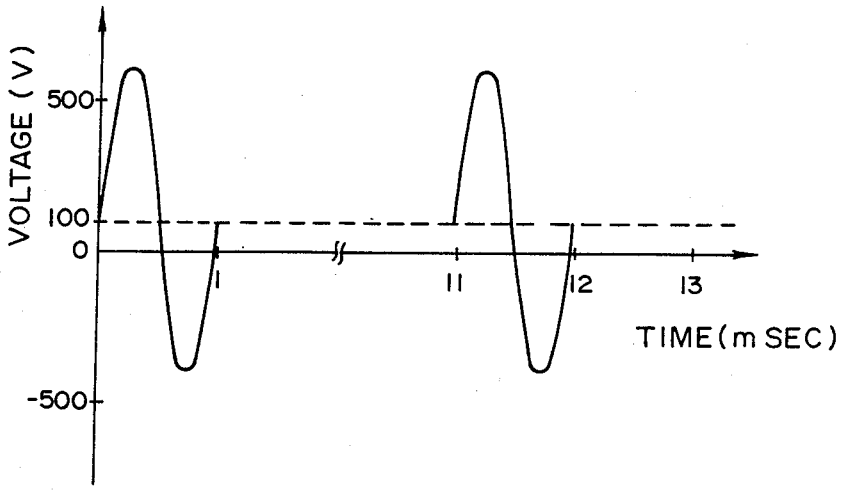
Figure 15:
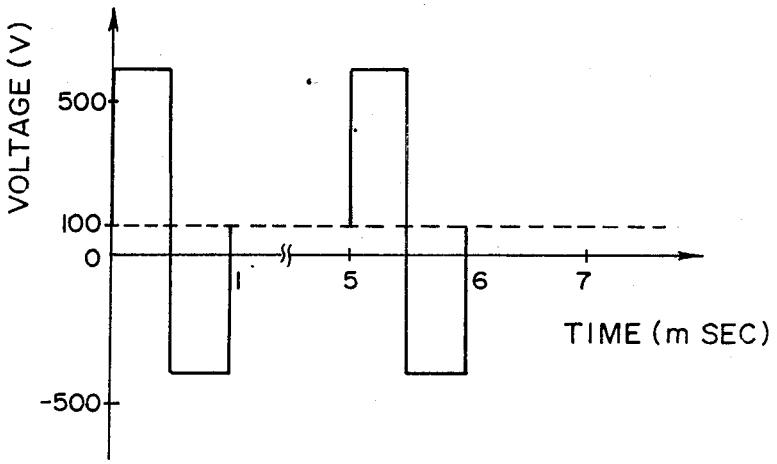

When this device was actually operated, it was confirmed that the white line corresponding to the position X of FIG. 10 had been removed, and the white lines corresponding to the positions Y and Z had been reduced to such an extent that they were not easily noted. As an alternative, two cycles of the waveforms of the voltage may be applied with the rest period corresponding to 5 cycles thereof as shown in FIG. 13, or one cycle thereof may be applied with the rest period corresponding to 10 cycles thereof as shown in FIG. 14. Also, a rectangular waveform as shown in FIG. 15 or triangular waveform may be used. The most suitable pattern of the bias voltage application can be selected in accordance with the desired copying speed and the developing conditions. The preferable results were obtained when the ratio of the bias voltage applying period and the rest period was 1:½–1:10.

Additional experiments were carried out wherein the frequency of the bias voltage was decreased, and such a bias voltage was continuously applied. However, it showed a little improvement of the stripe removal. The reason for this is thought to be as follows. It is assumed that the number of the reciprocations of the developer particles for one second, for example, is constant. Then, when the bias voltage of low frequency is applied, the developer particles repeat the reciprocal movements in accordance with the frequency of the bias voltage. On the other hand, when the bias voltage of a high frequency is applied as pulses, the movements of the developer particles can not completely follow the alternation in the bias voltage. Therefore, even if the number of cycles of the voltage applied is the same, the movements of the developer particles are different so that the results are different.

As has been described with FIGS. 7–9, the ending polarity of the intermittent alternating bias is so selected that the developer particles are transferred back from the latent image bearing member to the developer carrying member. This can be employed in this embodiment so that the foggy background and the toner scattering can be prevented.

As described above, according to this embodiment of the present invention, an intermittent alternating electric field is applied across the clearance between the latent image bearing member and the developer carrying member, so that, even if there is non-uniformness in the magnetic flux density distribution of the developing magnetic pole, the formation of the stripes corresponding to the non-uniformness can be reduced or eliminated. Also, the reduction of the image density or the production of the foggy background, which are possible when the frequency of the bias voltage is decreased, can be prevented.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing a latent image formed on a latent image bearing member, comprising:

a developer carrying member having a surface for carrying thereon a layer of developer, said developer carrying member being exposed, at a developing position, to the latent image bearing member with a clearance therebetween; and means for applying a developing bias to apply an alternating electric field across the clearance, wherein said developing bias applying means applies the alternating electric field across the clearance during a first period of the developing operation and does not apply the alternating electric field thereacross during a second period of the developing operation.

2. An apparatus according to claim 1, wherein said first period and second period are alternately and periodically repeated.

3. An apparatus according to claim 2, wherein the ratio between the first period and the second period is from 1:½ to 1:10, inclusive.

4. An apparatus according to claim 2, wherein a frequency of the alternating electric field in constant during the first period.

5. An apparatus according to claim 1, wherein said developing bias applying means terminates alternating field application at a time when the field has a polarity opposite to that of the developer, wherein positiveness of the polarity of the alternating field is defined as a value higher than a central value of the alternating field, and negativeness of the polarity of the field is defined as a value lower than the central value.

6. An apparatus according to claim 1, wherein said developing bias applying means applies, as the alternating electric field, a field having an AC voltage superposed with a DC voltage.

7. A developing apparatus for developing a latent image formed on a latent image bearing member, comprising:

a developer carrying member having a surface for carrying thereon a layer of a developer, said developer carrying member being exposed, at a developing position, to the latent image bearing member with a clearance therebetween; and means for applying a developing bias to apply an alternating electric field across the clearance, and for terminating alternating field application at a time when the field has a polarity opposite to that of the developer, wherein positiveness of the polarity of the alternating field is defined as a value higher than a central value of the alternating field, and negativeness of the polarity of the field is defined as a value lower than the central value.

8. A method of development comprising the steps of:

forming a thin layer of developer on a surface of a developer carrying member;

exposing the surface of the developer carrying member to a latent image bearing member bearing a latent image to be developed with a clearance therebetween which is larger than the thickness of the thin developer layer at a developing position; and developing the latent image, during which step an alternating electric field is applied across the clearance, said developing step including a first period during which the alternating electric field is applied across the clearance and a second period during which the alternating electric field is not applied thereacross.

9. A method according to claim 8, wherein said first period and second period are alternately and periodically repeated.

10. A method according to claim 8, wherein a frequency of the alternating electric field is constant during the first period.

11. A method according to claim 8, wherein the alternating field is provided by superposing a DC component and an AC component, and wherein during the second period the AC component is not applied, but the DC component is applied.

12. A method according to claim 11, wherein the DC component is applied throughout the first and second periods.

13. A method according to claim 8, wherein the second period is longer than the first period.

14. A method according to claim 8, wherein the ratio between the first period and the second period is from 1:½ to 1:10, inclusive.

15. A method of development comprising the steps of:

forming a thin layer of developer on a surface of a developer carrying member;

exposing the surface of the developer carrying member to a latent image bearing member bearing a latent image to be developed with a clearance therebetween which is larger than the thickness of the thin developer layer at a developing position; and developing the latent image, during which an alternating electric field is applied across the clearance, said developing step including a first period during which the alternating electric field is applied across the clearance and a second period during which a different electric field is applied thereacross.

16. A method of development comprising the steps of:

forming a thin layer of developer on a surface of a developer carrying member;

exposing the surface of the developer carrying member to a latent image bearing member bearing a latent image to be developed with a clearance therebetween which is larger than the thickness of the thin developer layer at a developing position;

developing the latent image, during which an alternating electric field is applied across the clearance, wherein the latent image is developed with the developer electrically charged to a polarity opposite to that of the latent image; and terminating alternating field application at a time when the field has a polarity opposite to that of the developer, wherein positiveness of the polarity of the alternating field is defined as a value higher than a central value of the alternating field, and negativeness of the polarity of the field is defined as a value lower than the central value.

17. A method of development comprising the steps of:

forming a thin layer of developer on a surface of a developer carrying member;

exposing the surface of the developer carrying member to a latent image bearing member bearing a latent image to be developed with a clearance therebetween which is larger than the thickness of the thin developer layer at a developing position;

developing the latent image, during which an alternating electric field is applied across the clearance, said developing step including a first period during which the alternating electric field is applied across the clearance and a second period during which the alternating field is not applied thereacross, wherein the latent image is developed with the developer electrically charged to a polarity opposite to that of the latent image; and terminating alternating field application at a time when the field has a polarity opposite to that of the developer, wherein positiveness of the polarity of the alternating field is defined as a value higher than a central value of the alternating field, and negativeness of the polarity of the alternating field is defined as a value lower than the central value.

18. A method according to claim 17, wherein the ratio between the first period and the second period is from $1:\frac{1}{2}$ to 1:10, inclusive.

* * * * *

UNITED STATES PATENT AND TRADEMARK OFFICE

CERTIFICATE OF CORRECTION

PATENT NO. : 4,610,531

DATED : Sept. 9, 1986

INVENTOR(S) : Nobuhiro Hayashi et al.

It is certified that error appears in the above-identified patent and that said Letters Patent is hereby corrected as shown below:

COLUMN 1

Line 58, "half-toner" should read --halftone--.

COLUMN 3

Line 30, "such a force" should read --such force--.

COLUMN 4

Line 33, "by the gravity" should read --by gravity--.
Line 48, "circultaion" should read --circulation--.

COLUMN 5

Line 10, "above described" should read --above-described--.
Line 41, "a organic" should read --an organic--.

COLUMN 6

Line 33, "11" should read --10--.
Line 46, "density, are" should read --density are--.

COLUMN 8

Line 36, "votlage" should read --voltage--.

UNITED STATES PATENT AND TRADEMARK OFFICE

CERTIFICATE OF CORRECTION

PATENT NO. : 4,610,531

DATED : Sept. 9, 1986

INVENTOR(S) : Nobuhiro Hayashi et al.

It is certified that error appears in the above-identified patent and that said Letters Patent is hereby corrected as shown below:

COLUMN 9

Line 32, "coying" should read --copying--.

COLUMN 10

Line 21, "maintained 250" should read --maintained at 250--.

Signed and Sealed this

Fourteenth Day of April, 1987

*Attest:*

DONALD J. QUIGG

*Attesting Officer*

*Commissioner of Patents and Trademarks*